United States Patent [19]

Grassle et al.

[11] Patent Number: 4,805,352

[45] Date of Patent: Feb. 21, 1989

[54] FLYER DOFFER FOR AUTOMATICALLY REPLACING FULL ROVING BOBBINS WITH EMPTY ROVING BOBBINS

[75] Inventors: Herbert Grassle, Schwäbisch-Gmünd-Metlangen; Manfred Hauers, Viersen; Dieter Vits, Neuss; Hans-Peter Weeger, Hattenhofen, all of Fed. Rep. of Germany

[73] Assignee: Zinser Textilmaschinen GmbH, Ebersbach/Fils, Fed. Rep. of Germany

[21] Appl. No.: 93,585

[22] Filed: Sep. 4, 1987

[30] Foreign Application Priority Data

Sep. 4, 1986 [DE] Fed. Rep. of Germany ..... 3630214

[51] Int. Cl.[4] ..... D01H 9/08; D01H 9/10; D01H 9/18

[52] U.S. Cl. ..... 57/267; 57/268; 57/270; 57/281

[58] Field of Search ..... 57/266–270, 57/274, 275, 281

[56] References Cited

U.S. PATENT DOCUMENTS

| | | | |
|---|---|---|---|
| 3,380,238 | 4/1968 | Araki et al. | 57/267 |
| 3,935,699 | 2/1976 | Iida et al. | 57/267 |
| 3,990,222 | 11/1976 | Marzoli | 57/267 |
| 4,389,840 | 6/1982 | Briner et al. | 57/267 |
| 4,413,299 | 2/1982 | Gunkinger et al. | 57/267 |

*Primary Examiner*—John Petrakes
*Attorney, Agent, or Firm*—Herbert Dubno

[57] ABSTRACT

An apparatus for automatic exchange of at least one full bobbin with at least one empty bobbin in a flyer, i.e. a flyer doffer, comprises a transport device reaching the flyer acting to transport the full bobbins and the empty bobbins, a doffing region and a mounting region which reach the spindles of the flyer for groupwise exchange of the full bobbins with the empty bobbins on the spindles and a lifting region reaching the transport device for groupwise exchange of the full with empty roving bobbins on the transport device. The doffing region and the mounting region on one hand and the lifting region on the other hand are spatially separate from each other. An exchanging region extending to the doffing, mounting and lifting regions is provided. Advantageously the doffing region and the mounting region are combined in a single doffing and mounting region.

17 Claims, 6 Drawing Sheets

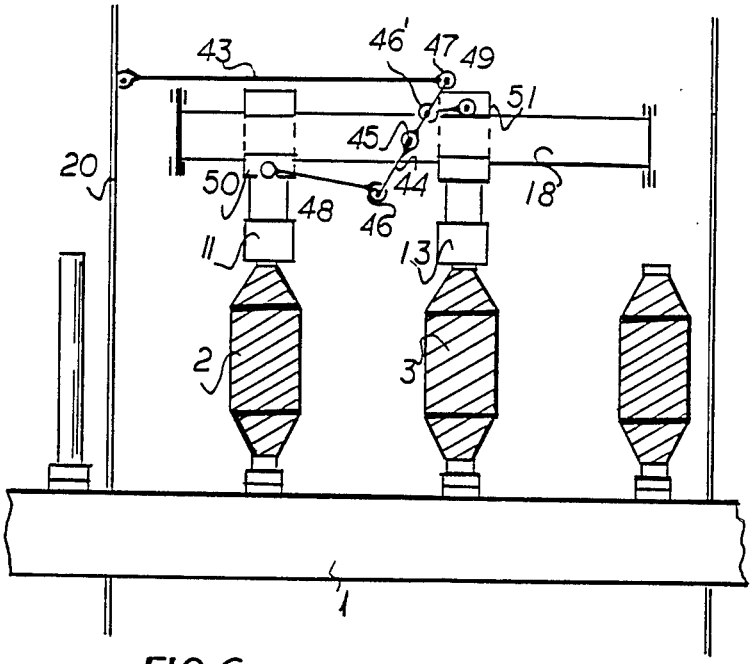
FIG.6
FIG.7
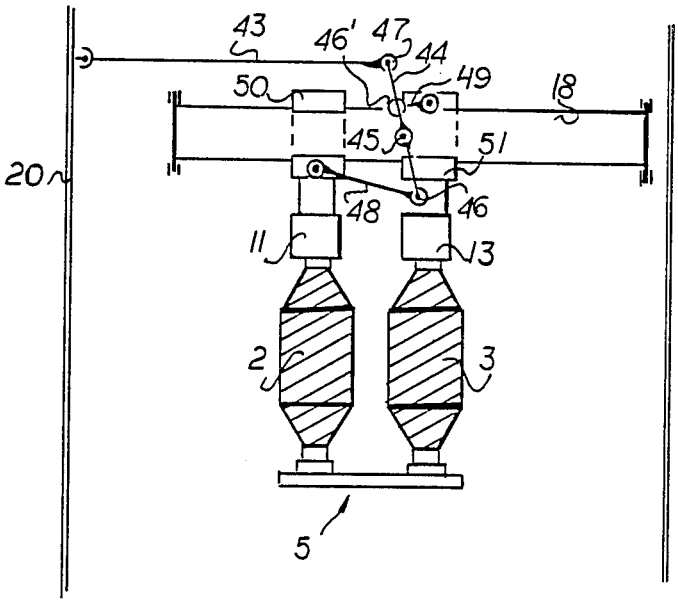

FLYER DOFFER FOR AUTOMATICALLY REPLACING FULL ROVING BOBBINS WITH EMPTY ROVING BOBBINS

FIELD OF THE INVENTION

Our present invention relates to a flyer doffer, i.e. to an apparatus for automatic exchange or replacement of a full bobbin with an empty bobbin in a flyer frame, flyer or the like.

BACKGROUND OF THE INVENTION

An apparatus for automatic exchange of a full bobbin with an empty bobbins in a flyer, i.e. a flyer doffer, can comprise a transport device removing the full bobbins from and delivering the empty bobbins to the flyer, a doffing region and a mounting region which reach the spindles of the flyer for groupwise exchange of the full bobbins with the empty bobbins on the spindles and a lifting region extending to the transport device for groupwise exchange of the empty with the full roving bobbins on the transport device.

An apparatus for exchanging bobbins as described above is already known in which the working regions are spatially connected and which, apart from involving complicated operations, has a time delay in regard to the automatic exchange of a full roving bobbin with an empty roving bobbin (U.S. Pat. No. 3,935,699).

OBJECTS OF THE INVENTION

It is an object of our invention to provide an improved flyer doffer or apparatus for automatically replacing a full roving bobbin with an empty roving bobbin in a flyer.

It is also an object of our invention to provide an improved flyer doffer or apparatus for automatically replacing a full roving bobbin with an empty roving bobbin in a flyer which is automated to a higher degree in a simple way.

It is another object of our invention to provide an improved flyer doffer or apparatus for automatically replacing a full roving bobbin with an empty roving bobbin in a flyer which does not have a disadvantageously complicated operation with an unnecessary time delay.

SUMMARY OF THE INVENTION

These objects and others which will become more readily apparent hereinafter are attained in accordance with our invention in a flyer doffer or an apparatus for automatic exchange of a full bobbin with an empty bobbins in a flyer comprising a transport device extending to the flyer acting to transport the full bobbins and the empty bobbins, a doffing regions and a mounting region which reach the spindles of the flyer for groupwise exchange of the full bobbins with the empty bobbins on the spindles and a lifting region extending to the transport device for groupwise exchange of the empty with the full bobbins on the transport device.

According to our invention the doffing region and the mounting region on one hand and the lifting region on the other hand are spatially separate from each other and an exchanging region extending to the doffing, mounting and lifting regions is provided. Advantageously this ensures that the individual operations can occur in parallel in a timely fashion whereby a considerable saving of time results during the exchange process.

In one case, the mounting region and the doffing region are combined. Alternatively the mounting region and the doffing region are spatially separate from each other.

According to a feature of our invention, the flyer doffer further comprises a gripper and holder operating in the doffing region and the mounting region for removing the full bobbins from the spindles, for depositing the full bobbins on a bobbin carrier, for removing the empty bobbins from the bobbin carrier and for mounting the empty bobbins on the spindles, a lifting device operating in the lifting region for moving the full bobbins to the transport device, and an exchange device operating in the exchanging region which shifts the bobbins between the regions. The gripper and lifter and the lifting device are advantageously operable independently of each other and simultaneously.

Advantageously in flyers in which the opposing spacings of the bobbins in the bobbin bank and in the transport device are different, the organs of the gripper and lifter carrying the bobbins are variable in regard to the opposing spacings.

In our apparatus in which the bobbins in the vicinity of the work stations are movable into an inclined delivery position from a vertical working position in the flyer, the gripper of the gripper and lifter can be pivotally mounted about a horizontal axis and provided with a group of raisable and lowerable gripping elements corresponding to the full roving bobbins to be removed for transfer from a mounted position into an exchange position and/or from the exchange position into a doffed position.

These gripping elements are advantageously connected by at least one double articulation in the form of twin pivots and crank members. The gripping elements can be guided slidably on two rails opposite each other and can have a changeable spacing with respect to each other.

The rails associated with the pivotally mounted gripper are mounted on a plurality of the crank members and are connected by a plurality of coupling members with a housing which is not pivotable.

Further the exchange device is provided with a rotatable transport disk and, can have at least two positions spaced from each other and at least one plate may be positioned thereupon having a plurality of receiving prongs for the roving bobbins. The plate can be movable into the lifting region from the mounting and/or doffing region by the transport disk and vice versa.

The plate provided with the receiving prongs can be movable by the lifting device from the exchange region to a hanger track of the transport device. The hangers located on the hanger track can be moved back stepwise. The lifting region can be positioned between the doffing region and the mounting region and all three regions are connected with each other by a transporting element acting as an exchange device.

Additionally the exchange device can be a transport belt provided with a plurality of receiving prongs. The gripper lifter, the transport device, the lifting device and the hanger track can be connected with a control device.

BRIEF DESCRIPTION OF THE DRAWING

The above and other objects, features and advantages of our invention will become more readily apparent from the following description, reference being made to the accompanying highly diagrammatic drawing in which:

FIG. 6 is a front view of the objects in FIG. 4 as shown in FIG. 4;

FIG. 7 is a front view of the objects in FIG. 5 as shown in FIG. 5; and

SPECIFIC DESCRIPTION

Figure 1:
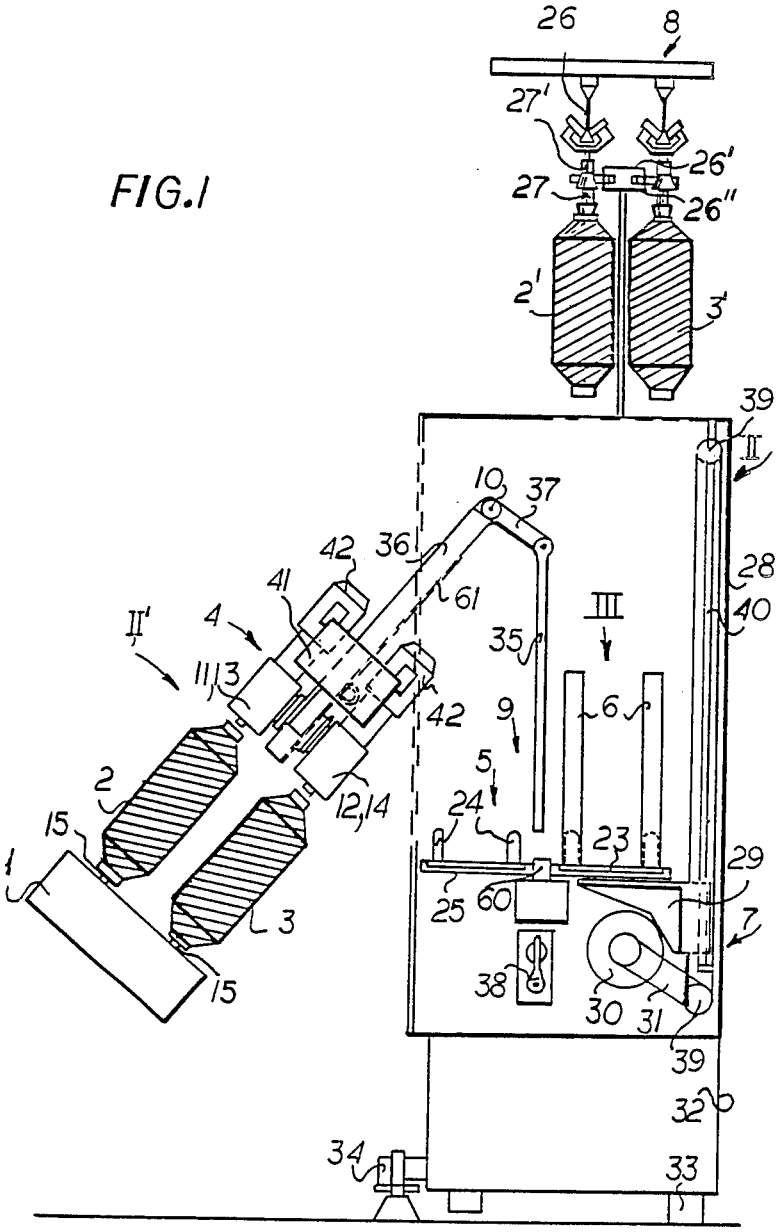
FIG. 1 is a side elevational view of the flyer doffer apparatus for exchanging roving bobbins according to our invention with a bobbin bank of the flyer swung out.

A doffing region I and a mounting region I' for groupwise replacement of full roving bobbins 2 and 3 on the spindles 15 of a bobbin bank 1 of a flyer is provided in this as seen in FIG. 1. In the structure shown in FIG. 1 the bobbin bank 1 is shown to have been moved into an inclined removing position from an unshown vertical operation. This corresponds to the structure described in German Patent No. 28 38 398.

A lifting region II is also provided which serves for groupwise exchange of empty with full roving bobbins with reference to a transport device 8. This transport device 8 comprises a hanger track 26 on which hangers 27 are positioned by carriages. The hanger tracks 26 extend above the flyer longitudinally. The transport device 8 has a transport drive 26' with two pivotable thrusting arms 26'' which engage behind the hangers 27 and push the hangers 27 attached in an unshown way to chains or mounted on the carriages 27' about two hanger intervals in succession (the spacing of two doffing positions minus twice the hanger spacing).

As is apparent from FIG. 1 the doffing region I and the mounting region I' on the one hand and the lifting region II on the other hand are separated spatially from each other.

An exchanging region III extending into the regions I,I' and II is provided. This exchanging region III has an exchange device 9 which shifts bobbin carrier 5 between the doffing and mounting regions I,I' and the lifting region II. The doffing and mounting region I,I' is equipped with a gripper and lifter 4. The lifting region II has lifting device 7. According to our invention the gripper and lifter 4 and the lifting device 7 are operable independently of each other and are operable at the same time.

The gripper and lifter 4 acts in the doffing region I and mounting region I'. It takes full bobbins 2 and 3 from the spindles 15 of the bobbin bank 1 and deposits them on the bobbin carrier 5. After that it takes the empty bobbins 6 from a bobbin carrier 5 and puts these bobbins 6 on the spindles 15.

To perform this operation the gripper and lifter 4 is provided with gripping elements 11, 12, 13 and 14 according to FIGS. 3 to 7.

The gripping elements 11 to 14 operable by gripping element drives 42 are slidable pairwise on rails 18 and 19 by sliding mounts 50, 51 which are attached with each other pivotally in a parallelogram linkage by rocker arms 52, 53.

Each of the rocker arms 52 and 53 is pivotly mounted on a carriage 41 which for its part is slidable on a rail 36. There is a separate carriage 41 and rail 36 for each rocker arm. Each rail has a rack on which the carriage 41 is slidable in synchronization with the other carriage 41 by a pinion driven through non-illustrated motor on the carriage to perform the doffing process of the full roving bobbins 2 and 3 from the spindles 15 and/or the mounting process for the empty bobbins on the spindles 15.

The rails 36 are pivotable about the axes 10 which are located in the upper portion of a parallel carriage 32 movable toward the flyer. This carriage 32 has rollers 33 and justifying elements 34 and may move by a non-illustrated drive device along the flyer to perform the exchange process.

One of the rails 36 is rotatably mounted with an additional lever 37 which is connected by a drive rod 35 with a drive 38 mounted in carriage 32. If the drive rod 35 is now raised the lever 37 and the rail 36 pivot the gripper and lifter 4 about the axis 10. Also it moves from the inclined position counterclockwise in FIG. 1 into the exchanging region III which means into a vertical delivering and/or receiving position.

The exchange device 9 of the exchanging region III has a transport disk 25 rotatable about a vertical rotation axle 60 on which plates 23 with a plurality of receiving prongs 24 are positionable. By rotation of the transport disk 25 about the axle 60 the plates 23 thus move from the left into the right side of the figure (FIG. 1). The plates 23 with the receiving prongs 24 lie in this right side position above a lifter plate 29 of the lifting device 7.

Figure 2:
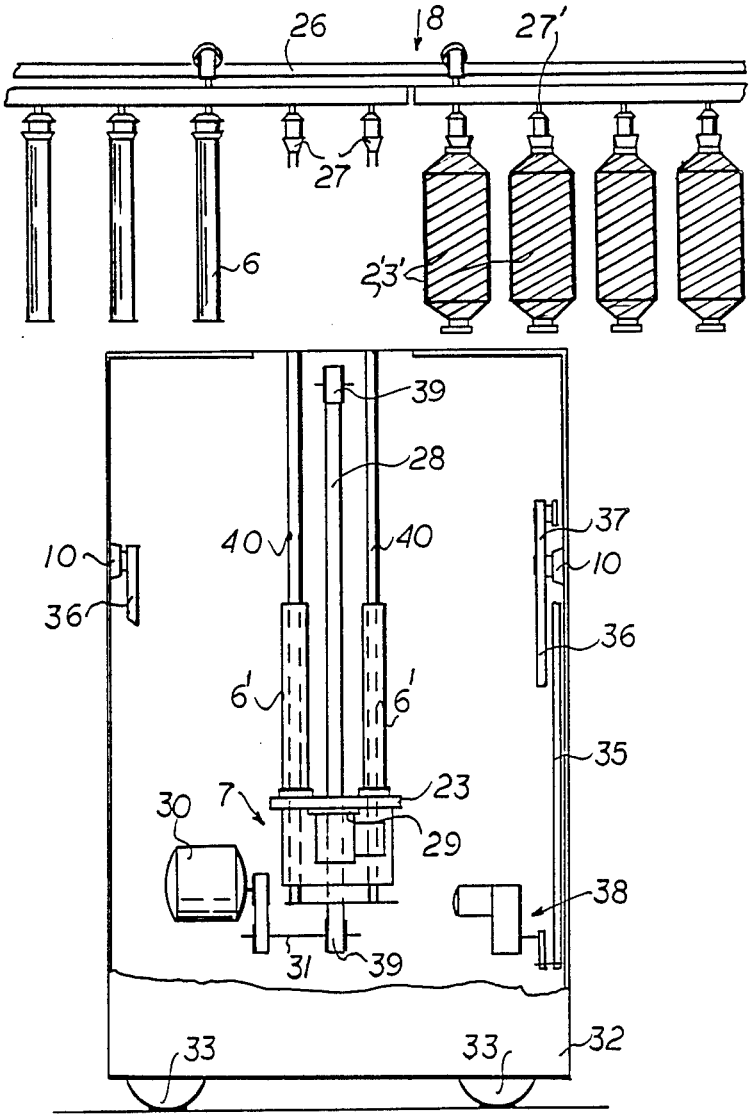
FIG. 2 is a front elevational view of the apparatus according to our invention.

The lifter plate 29 of the lifting device 7 is attached to an endless pulling member 28 which runs over guide roller 39 and is guided on two guide rods 40 according to FIGS. 1 and 2. The pulling member 28 is moving by a motor 30 and a drive 31 so that the lifter plate 29 can be moved form the lower region according to FIG. 1 into the upper region of the transport device 8. Thus full roving bobbins 2 and 3 may be moved upwardly vertically from the lower region and put on the hanger 27 and also after that the empty bobbins 6 are shifted (FIG. 2) by being pulled from the hangers 27, and moved downwardly and via the exchange device 9 supplied to the gripper and lifter 4.

The full roving bobbins 2 and 3 which could be delivered to the hanger track 26 of the transport device 8 are moved out from the working regions and transported away.

Figure 3:
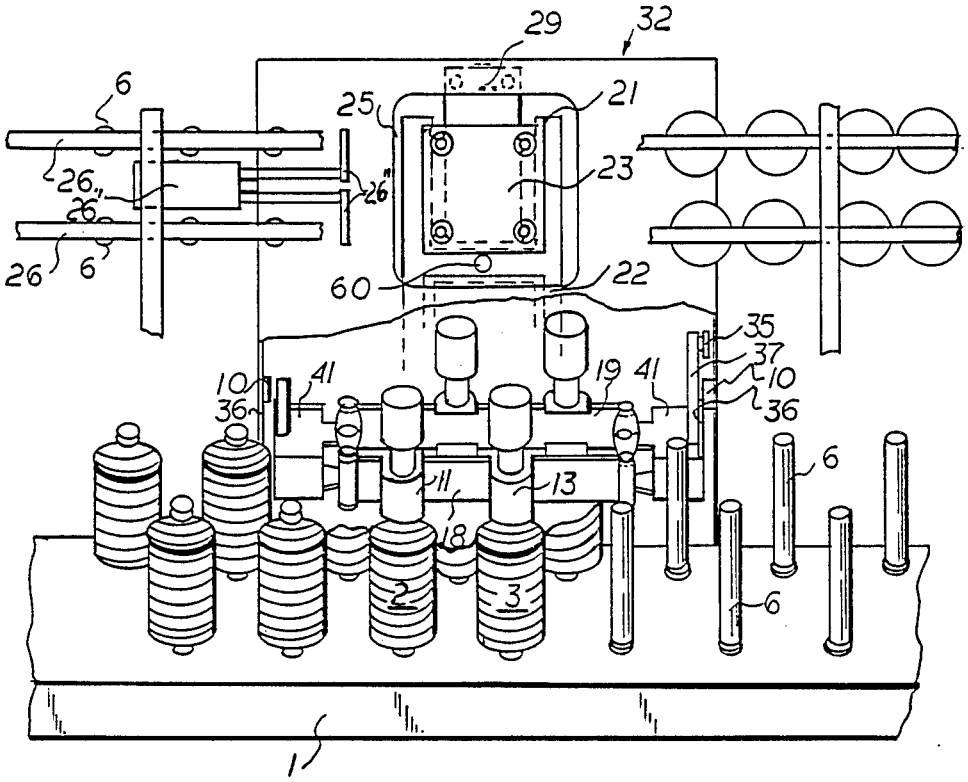
FIG. 3 is a top view of the apparatus of FIG. 1 and a perspective view of the bobbin bank of FIG. 1.

From FIG. 3 it is apparent that the four bobbins put on the spindles on the inclined spindle bank 1 which are taken from the four gripping elements 11, 12, 13 and 14 have a different spacing from each other than the four receiving prongs 24 on the bobbin carrier 5 which means the plate 23. The spacing of the gripping elements 11, 12, 13 and 14 from each other is different from the opposing spacing of the full bobbins on the spindles and the opposing spacing of the bobbins in the transport device.

Figure 4:
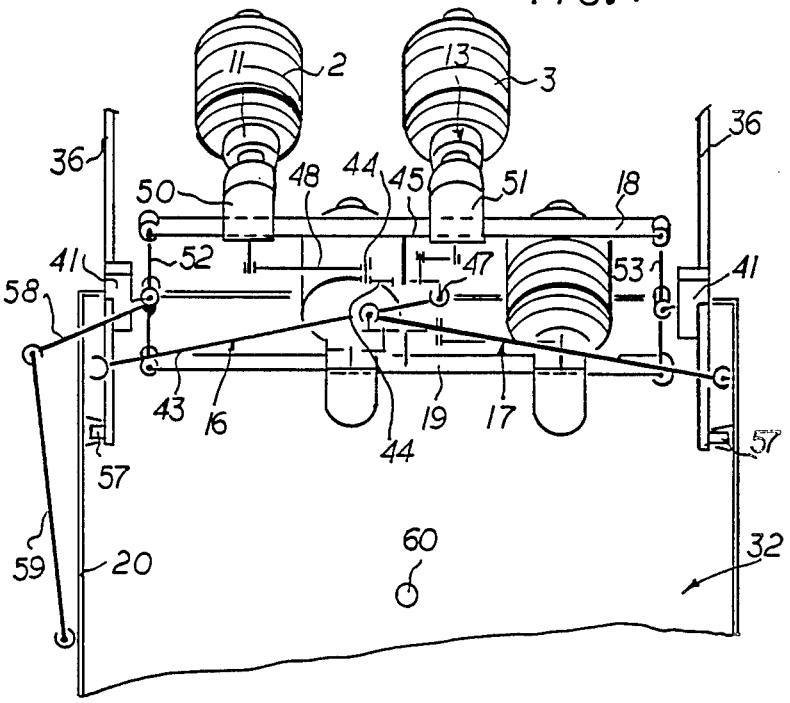
FIG. 4 is a partially perspective view of the gripper and lifter of the flyer doffer pivoted out as in FIG. 1.
Figure 5:
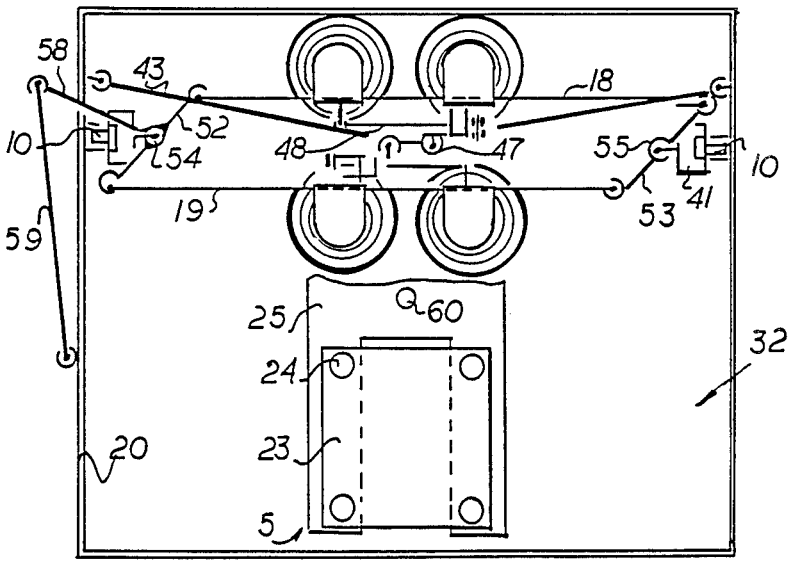
FIG. 5 is a plan view of the gripper and lifter of FIG. 4 in a vertical position.

As seen from FIGS. 4 to 6 the gripping elements 11 to 14 are attached with each other by double articulations 16 and 17 in the form of twin pivots and crank members.

A crank rod 43 which is attached by a joint 47 with a pivot lever 44 according to FIGS. 4 to 7 is pivotally connected to the housing 20 of the carriage 32 according to FIG. 4. This pivot lever 44 is pivotable about an axis 45 which is attached to the rail 18. The pivot lever 44 has two joint connection points 46 and 46' outside the joint 47 for the crank rod 43 so that the pivot connection point 46 is connected with a rod 48 which for its part is attached with the sliding mount 50 according to FIG. 6.

The pivot connection point 46' is pivotally connected with the rod 49 which for its part is connected with the sliding mount 51. Hence the sliding mounts 50 to 51 may slide on the rail 18 by pivoting of the pivot lever 44. The same structure is provided for the gripping elements 12 and 14 which for their part are movable on the rail 19.

A crank arm 58, which is connected to the housing 20 of the carriage 32 by a coupling member 59, is mounted on the rocker arm 52.

The rails 36 swing from the position in FIG. 1 and/or 4 to 6, i.e. the inclined position, into the vertical position so that the double articulation reaches the position according to FIGS. 5 and 7 from the position according to FIG. 4 and 6.

As a result of the pivotal connection by the coupling member 59 and the crank arm 58 the parallelogram linkage 52-18-53-19 is displaced from the rectangular shape according to FIG. 4 to the parallelogram shape according to FIG. 5. Then the rails 18 and 19 are displaced laterally. Because of this lateral pushing the pivot axis 45 of the pivot lever 44 is also displaced. Since this pivot lever 44 is connected by the crank rod 43 with the housing 20 it is also pivoted. Because of that the sliding mounts 50 and 51 are displaced by the rods 48 and 49 on the rails 18 and/or 19 approaching or nearing each other.

The sliding mounts 50, 51 and thus the gripping elements or organs 11 to 14 are moved toward each other also in two directions perpendicular to each other and because of that their spacing is reduced to the spacing on the hanger track 26 in the transport device 8. By suitable selection of the position of the pivot points and the length of the crank arms or rods and the coupling members the configuration of the gripping elements 11 to 14 is adjusted as required.

In the position according to FIG. 5 the full roving bobbins gripped by the gripping elements 11 to 14 may be put on the receiving prongs 24.

In the time is which the four full bobbins can be taken from the flyer and can be transferred to the transport disk 25, the gripper and lifter 4 has four empty bobbins put on from above which means fetches the hangers 27 and puts them on the receiving prongs 24.

After performing this operation the transport disk 25 rotates about the rotary axle 60.

Since this transport disk 25 has a recess shown with dashed lines in FIG. 5 now the lifter plate 29 according to FIG. 1 can engage under the plate 23 and the four full roving bobbins 2 and 3 can be put on the hangers 27 of the hanger track 26 of the transport device 8.

For the yarn working it is advantageous that the front and rear bobbin rows of the flyer correspond with separate hangers, which means that the rear bobbins of the flyer are always delivered on the same hanger. This is the same for the front.

After that the transport device 8 advances by transport drive 26' approximately by a distance corresponding to four hangers 27. The hangers 27 are advantageously of a known construction to which the bobbins are coupled by simply lifting them onto the hangers.

By rotation of the transport disk 25 four empty bobbins 6 are brought into the vicinity of the vertically positioned gripping elements 11 to 14. These are lowered, grip the empty bobbins, move themselves from the narrow position shown in FIGS. 5 to 7 into the inclined position according to FIG. 1, whereby by the described double articulations the spaces between the individual gripping elements are again enlarged and are aimed at the spacing of the spindles of the spindle bank 1 of the flyer.

The spacing of the gripping elements 11–14 with respect to each other is thus automatically changeable by the double articulation between the opposing spacing of the bobbins on the spindles of the bobbin bank and the opposing spacing of the bobbins on the transport device 8.

After putting on the empty bobbins 6 the carriage 32 moves about four spindles further where the same process is repeated.

Figure 8:
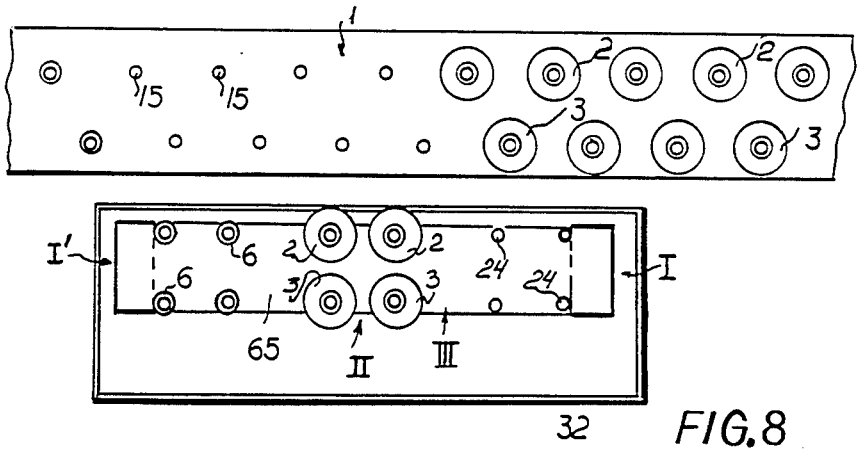
FIGS. 8 to 10 are top plan views of other examples of the apparatus for exchanging bobbins according to our invention with both ends of the spindle bank broken away in three successive stages of operation.
Figure 9:
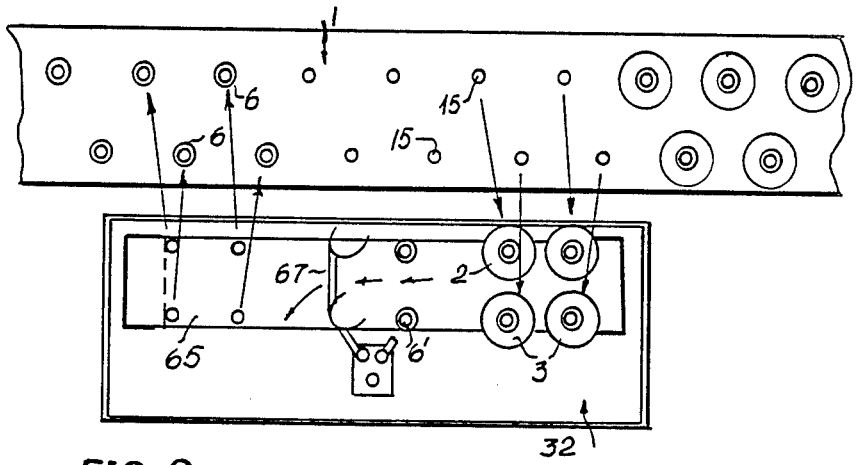
Figure 10:
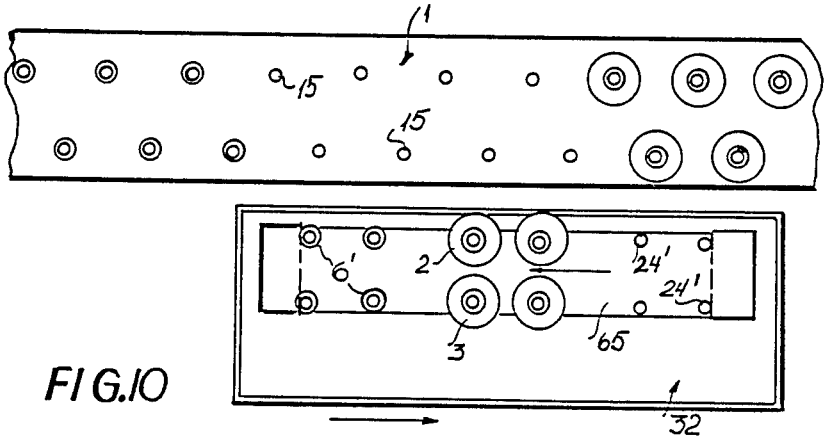

While the doffing region I and the mounting region I' in the example according to FIGS. 1 to 3 are seen to coincide in the example according to FIGS. 8 to 10 the doffing region I and the mounting region I' are spatially separate from each other. FIGS. 8 to 10 show a bobbin bank 1 in a top view, laterally cutaway and a carriage 32. A transporting element 65 is located on this carriage 32, for example a transport belt, which acts as an exchange device. The lifting region II is located between the doffing region I and the mounting region I'. All three regions, namely I, I' and II, are connected with each other by the transport element 65. The transporting element 65 is advantageously a transport belt with a plurality of receiving prongs.

According to FIG. 8 three times four receiving prongs 24' are located in working positions by which four full roving bobbins 2 and 3 and for other empty roving bobbins 6 are carried.

By the above described gripper and lifter 4, see FIG. 9, four full roving bobbins 2 and/or 3 from the bobbin bank 1 are put on by the bobbin bank 1 on the empty receiving prongs 24' of the transport element 65 in the doffing region I. Simultaneously four empty bobbins 6 from the transporting element 65 in the mounting region I' are mounted on the empty spindles 15 of the bobbin bank 1.

Moreover in the lifting region II the four full roving bobbins 2 and/or 3 taken off the transporting element 65 in the previously described exchange process are lifted by the vertically movable gripping and lifting arm 67 until they arrive in the vicinity of the hanger track 26 and there are delivered to the hangers 27. The gripping and lifting arm 67, after the carriage 27' moves a suitable amount, takes four empty bobbins from the hanger track 26 and puts them on the corresponding receiving prongs of the transport element 65 whereafter this gripping and lifting arm 67 is swung out in the direction of the arrow so that it does not prevent the motion of the transport element 65.

According to FIG. 10 the carriage has moved a certain distance which means from left to right a distance approximately equivalent to four spindles, whereby simultaneously the transporting element 65 could be pulled back in the opposing direction a certain amount. Thus the initial situation according to FIG. 8 at the next four bobbins 2,3 of the spindle bank 1 is attained. Four full roving bobbins 2 and 3 stand opposite four empty receiving prongs 24', four full roving bobbins 2 and 3 can be moved on the transporting element 65 to the hanger track, four empty bobbins 6' are prepared for transfer to the empty spindles 15 on the roving bank 1.

The transport elements 65 can also be formed as threaded spindles or chains by which plates 23 are displaced.

A time-saving exchange process is performed in both examples by the cooperation of the gripper and lifter 4, the gripping elements 11 to 14, the exchange device 9 and the lifting device 7. Thus the gripper and lifter 4, the transport disk 25 of the exchange device and/or the gripping and lifting arm 67, the lifting device 7 and the hanger track 26 of the transport device 8 are combined with a control device not illustrated in detail so that the individual operations are exactly coordinated with each other.

By "twin pivots and crank members" referred to in claim 7 we mean for example the crank bar 43, the pivot joint 47 and the like linear connecting members and pivot joints.

By the "organs" referred to herein, we means "the gripping elements 11–14 and the receiving prongs 24.

We claim:

1. In a flyer doffer for automatic exchange of at least one full bobbin with at least one empty one of said bobbins in a flyer comprising a transport device extending to along said flyer to transport said full bobbins and said empty bobbins, a doffing region and a mounting region which extend over a plurality of spindles of said flyer for groupwise exchange of said full bobbins with said empty bobbins on said spindles and a lifting region extending to said transport device for groupwise exchange of said full with said empty bobbins on said transport device, the improvement wherein said doffing region and said mounting region on one hand and said lifting region on the other hand are spatially separated from each other, and an exchanging region is provided extending to said doffing, mounting and lifting regions, a bobbin carrier, a gripper and lifter being provided and operating in said doffing region and said mounting region for removing said full bobbins from said spindles, for depositing said full bobbins on said bobbin carrier, for removing said empty bobbins from said bobbin carrier and for mounting said empty bobbins on said spindles, a lifting device operating in said lifting region for moving said full bobbins to said transport device, and an exchange device operating in said exchanging region which shifts said bobbins between said regions, said gripper and lifter and said lifting device being operable independently of each other and simultaneously.

2. The improvement according to claim 1 wherein said doffing region and said mounting region are combined.

3. The improvement according to claim 1 wherein said doffing region and said mounting region are spatially separate from each other.

4. The improvement according to claim 3 further comprising an exchange device and a transporting element, wherein said lifting region is positioned between said doffing region and said mounting region and all three of said regions are connected with each other by said transporting element acting as said exchange device.

5. The improvement according to claim 4 wherein said exchange device is a transport belt provided with a plurality of receiving prongs.

6. The improvement according to claim 1 further comprising a bobbin bank carrying bobbins and having opposing spacings opposite said bobbins in said bobbin bank and which are different than opposing spaces in said transport device, the improvement wherein a plurality of organs of said gripper and lifter carrying said bobbins are variable in regard to said opposing spacings.

7. The improvement according to claim 1 further comprising a plurality of work stations in which said bobbins in the vicinity of said plurality of work stations are movable into an inclined delivery position from a vertical working position in said flyer, the improvement wherein the gripper of said gripper and lifter is pivotally mounted about a horizontal axis and is provided with a group of raisable and lowerable gripping elements corresponding to said full bobbins to be removed for transfer of said bobbins from a mounted position into an exchange position and/or from said exchange position into a doffed position.

8. The improvement according to claim 7 wherein said gripping elements are connected by at least one double articulation in the form of twin pivots and crank members.

9. The improvement according to claim 7 further comprising two nails opposite each other wherein are slidably guided said gripping elements, and said gripping elements having a changeable spacing with respect to each other.

10. The improvement according to claim 9 further comprising a plurality of crank members, a plurality of coupling members, and a housing, wherein said rails associated with said gripper which is pivotable are mounted on said plurality of crank members and are connected by said plurality of coupling members with said housing which is not pivotable.

11. The improvement according to claim 9 further comprising a plurality of crank members, a plurality of coupling members, and a housing, wherein said gripping elements associated with said gripper which is pivotable are connected by said plurality of coupling members with said housing which is not pivotable.

12. The improvement according to claim 1 wherein said exchange device is provided with a transport disk having at least two positions spaced from each other, and upon said disk is positioned at least one plate provided with a plurality of receiving prongs for said bobbins.

13. The improvement according to claim 12 wherein said plate is movable into said lifting region from said mounting and/or doffing region by said transport disk and in reverse.

14. The improvement according to claim 12 further comprising a hanger track having a plurality of hangers in said transport device and wherein said plate provided with said receiving prongs is movable by said lifting device from said exchanging region to said hanger track.

15. The improvement according to claim 14 wherein said hangers located on said hanger track are moved stepwise.

16. The improvement according to claim 15 further comprising a control device wherein said gripper and lifter, said transport device, said lifting device and said hanger track are connected with a control device.

17. A flyer doffer for automatic exchange of at least one full bobbin with at least one empty one of said bobbins in a flyer in which said bobbins in the vicinity of a plurality of work stations are movable into an inclined delivery position from a vertical working position in said flyer, said flyer doffer comprising:

a transport device extending to along said flyer to transport said full bobbins and said empty bobbins;

a combined doffing and mounting region which extends over a plurality of spindles of said flyer for groupwise exchange of said full bobbins with said empty bobbins on said spindles;

a lifting region spatially separate from said doffing and mounting region;

an exchanging region extending to said doffing and mounting region and said lifting regions;

a bobbin carrier for transporting bobbins;

a gripper and lifter operating in said doffing and mounting region for removing said full bobbins from said spindles, for depositing said full bobbins on said bobbin carrier, for removing said empty bobbins from said bobbin carrier and for mounting said empty bobbins on said spindles, said gripper and lifter comprising:

a gripper pivotally mounted on a horizontal axis, a group of raisable and lowerable gripping elements corresponding to said full bobbins to be removed for transfer of said bobbins from a mounted position into an exchange position and/or from said exchange position into a doffed position;

twin pivots;

a pair of crank members;

a pair of coupling members;

at least one double articulation comprising said twin pivots and crank members, said gripping elements being connected by said double articulation, a housing;

two rails opposite each other which are mounted on said plurality of crank members and connected by said plurality of coupling members with said housing which is not pivotable, said gripping elements being guided slidably on said rails and having a changeable spacing with respect to each other;

a lifting device operating in said lifting region for moving said full bobbins to said transport device, said gripper and lifter and said lifting device being operable independently of each other and simultaneously;

a hanger track;

a transport disk;

a plurality of receiving prongs to receive said bobbins;

at least one plate provided with said plurality of receiving prongs; and an exchange device operating in said exchanging region which shifts said bobbins between said regions provided with said transport disk having at least two positions spaced from each other, and upon said transport disk is positioned said at least one plate provided with said plurality of receiving prongs for said bobbin, said plate being movable into said lifting region from said mounting and/or doffing region by said transport disk and in reverse, said plate provided with said receiving prongs being movable by said lifting device from said exchanging region to said hanger track.

* * * * *